United States Patent [19]

Fournier et al.

[11] 4,060,475

[45] Nov. 29, 1977

[54] ELECTROLYTIC CELL SUITABLE FOR PRODUCING ALKALI METAL CHLORATES

[75] Inventors: Daniel Fournier, Paris; Hugues Bourgeois, Chedde, both of France

[73] Assignee: Rhone-Poulenc Industries, Paris, France

[21] Appl. No.: 661,527

[22] Filed: Feb. 26, 1976

[30] Foreign Application Priority Data

June 3, 1975 France ..... 75.07008

[51] Int. Cl.[2] ..... C25B 1/16; C25B 1/26; C25B 9/02

[52] U.S. Cl. ..... 204/270; 204/269; 204/286; 204/288; 204/289

[58] Field of Search ..... 204/95, 252, 274, 268, 204/278, 286, 288, 270, 267, 289

[56] References Cited

U.S. PATENT DOCUMENTS

| | | | |
|---|---|---|---|
| 1,588,579 | 6/1926 | Holmboe | 204/288 |
| 2,511,686 | 6/1950 | Andre | 204/274 |
| 3,507,771 | 4/1970 | Donges et al. | 204/288 X |
| 3,598,715 | 8/1971 | Goens et al. | 204/95 X |
| 3,616,444 | 10/1971 | Raetzsch | 204/278 |
| 3,684,670 | 8/1972 | Raetzsch | 204/95 |
| 3,732,153 | 5/1973 | Harke et al. | 204/95 |
| 3,809,629 | 5/1974 | Messner et al. | 204/95 |
| 3,813,326 | 5/1974 | Gunby | 204/268 |

FOREIGN PATENT DOCUMENTS

| | | | |
|---|---|---|---|
| 928,245 | 6/1973 | Canada | 204/62 |
| 1,258,716 | 12/1971 | United Kingdom. | |

*Primary Examiner*—Arthur C. Prescott

[57] ABSTRACT

An electrolytic cell without a diaphragm is provided, having anodes and cathodes mounted, respectively, on an anode end and a cathode end, the ends being substantially vertical so as to provide an open space above the anode and cathode units; the cathodes being perforated, particularly at the top, so as to make the cathode space communicate with the open space provided above the anode and cathode units. The cell is particularly applicable to the production by electrolysis of alkali chlorates.

19 Claims, 10 Drawing Figures

ELECTROLYTIC CELL SUITABLE FOR PRODUCING ALKALI METAL CHLORATES

BACKGROUND OF THE INVENTION

The invention relates to a new electrolysis cell, without a diaphragm, particularly for continuous production of alkali metal chlorates and, in particular, sodium chlorate by electrolyzing a liquor containing sodium chloride, although it may equally be applied to the production of alkali hypochlorites or perchlorates Since the first commercial electrochemical production of chlorates goes back to over a century ago, it is not surprising that many types of cells have been proposed for this purpose. Since cells for chlorates normally have no diaphragm, one might think at first sight that they are simple cells, differing from one another only in a few technological details. This would be to overlook the fact that fairly complex phenomena take place in them, due particularly to the existence of a large number of reactions varying greatly in their kinetics.

Thus, in addition to the main anode and cathode reactions liberating chlorine and hydrogen, there are chemical reactions leading ultimately to the formation of chlorate, as well as parasitic reactions.

Thus, the equation $$3H_2O + NaCl \rightarrow NaClO_3 + 3\ H_2,$$

which is generally quoted to convey the whole phenomenon, gives an overly simplified view of the phenomena which take place and does not allow for the fact, e.g., that the reaction whereby chlorate is formed from hypochlorous acid is slow whereas the anode and cathode reactions are fast.

This explains why two very different approaches have come to the fore among the technological solutions proposed, one maintaining that the chemical reactions must take place as far as possible outside the cell, and the other, conversely, that everything should take place inside one and the same cell.

The latter concept is particularly attractive since it makes it possible to construct cell component arrangements which are more compact and, a priori, simpler. However, it encounters many difficulties in practice, due to the fact that the electrolytes need to be circulated, mixed and reacted inside the cell, for the reasons just stated, and also due to the fact that these arrangements must satisfy electro-chemical and electrotechnical requirements, such as the passge of the current, or thermal requirements such as dissipation of the heat produced, or kinetic requirements such as the need to being the various reagents together under specific conditions.

The practical problems which arise also include that of evacuating from the cell the gases formed. To facilitate interpolar release of gas, it has already been proposed, in French Pat. No. 947,057, to use cathodes comprising perforated metal plates which may contain 60% cavity. However, accumulation of gas in the interpolar space is known to exclude electrolyte from the space and consequently to increase electrical resistance between anode and cathode, thereby increasing the voltage and reducing the energy yield of the cell.

Attempts have been made to lessen this drawback by eliminating the gas as rapidly as possible from the critical space where the gases are formed. French Pat. No. 2,029,723 thus proposes the use of a cathode comprising a rear plate and a pervious plate, the pervious plate being located between and at a certain distance from the rear plate and the anode and having an oblique surface so as to allow gas to pass into a space provided between the rear plate and the pervious plate.

French Pat. No. 2,156,020 proposes a cell with a section for the formation of chlorates, located in the bottom of the cell below the active section, the active section being provided with deflectors in order to lengthen the reaction whereby hypochlorite is converted into chlorate.

U.S. Pat. No. 3,055,821 proposes a cell for high-temperature production of chlorates, designed so that the electrolyte circulates in a cell due to an ascending force resulting from the hydrogen formed being released between the electrodes and dropping onto the sides of the cell. A cell of this type has three stationary sides and one anode-carrying side, the anodes being arranged between the pairs of cathodes, and isolating spacers being disposed between the anodes and the cathodes.

All these solutions aim to produce the same result, viz., to improve the circulation of electrolyte, and have produced interesting results. But it is known that the present-day profitability requirement is becoming more and more critical, particularly as far as energy consumption is concerned.

Furthermore, in order to obtain good dimensional stability and durability and to increase current density, there is an increasing tendency to use metal anodes with dimensions which remain constant with the passage of time.

Use of these anodes has allowed maximum reduction in the interpolar distance, but the need to circulate the electrolyte and evacuate the gases has become more critical, since these anodes enable the cell to be operated at high temperatures. Finally, such cells must have minimum bulk and be simple enough in design to make them easy to construct, maintain and operate.

The cell which the present invention seeks to provide must, in particular, be simple from the technological point of view, must avoid the inclusion of complex circuits with large external volumes, thus eliminating the dangers of corrosion. It must be capable of operation at high temperature and must avoid the disadvantages which result from previous proposals, such as inclined ortions or additional components such as deflectors, complementary plates, etc.

The present invention also aims to provide a cell which will give maximum benefit from the use of electrodes with constant dimensions. These allow a reduction in interpolar space, thus enabling the operating voltage to be lowered, while at the same time avoiding the main drawback of such an arrangement, viz., the accumulation of gases in the interpolar space.

It is, therefore, an object of the present invention to provide an electrolytic cell, suitable for the production of alkali chlorates, which overcomes the disadvantages of the prior art.

It is also an object of the present invention to provide an electrolytic cell which provides the aforestated advantages of the present invention.

Other objects will be apparent to those skilled in the art from the present description, taken in conjunction with the appended drawings, in which.

Figure 4:
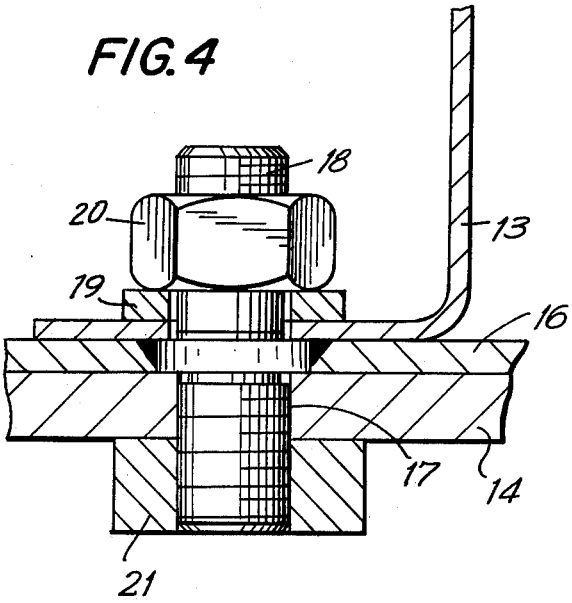
Figure 5:
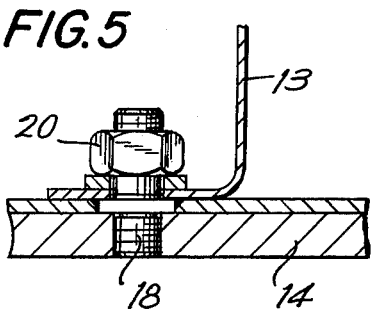

FIGS. 4 and 5 diagrammatically illustrate two methods of fixing the anodes.

Figure 6:
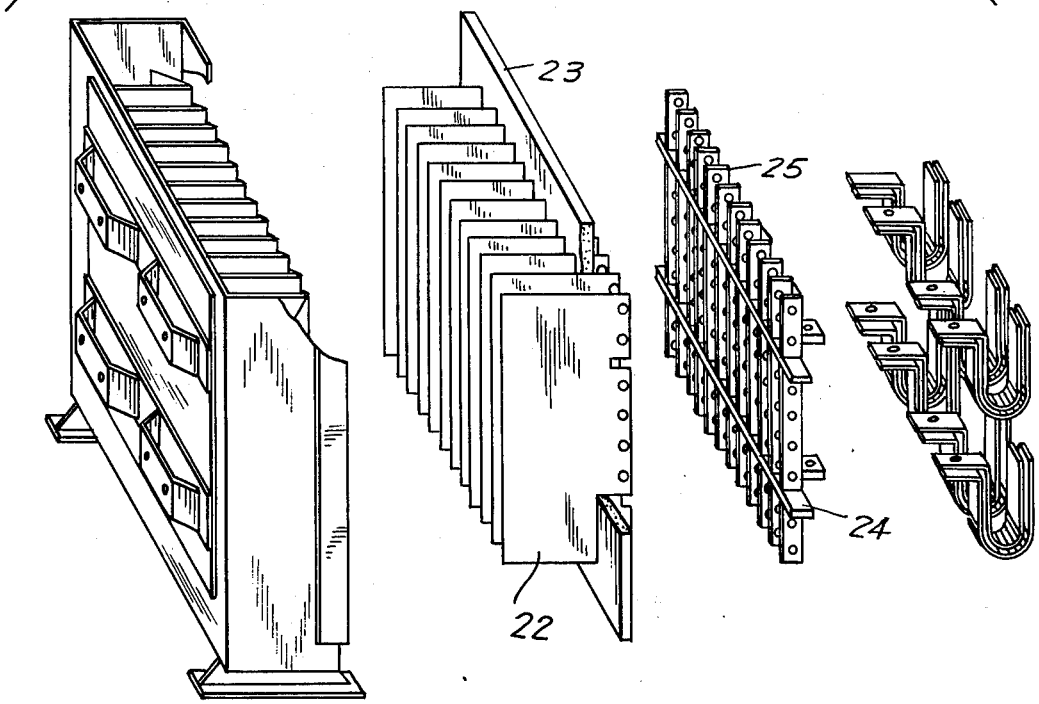

FIG. 6 illustrates a different embodiment with a non-conductive anode end, and

FIGS. 7 to 10 are diagrams which more particularly illustrate embodiments of the arrangement of anodes and cathodes according to the invention.

GENERAL DESCRIPTION OF THE INVENTION

The present invention comprises a new electrolytic cell, without a diaphragm, wherein products resulting from the anode and cathode reactions react together inside the cell. More particularly, the cell is most suitable for obtaining alkali chlorates from alkali chlorides. The cell of the invention comprises an anode block and a cathode block, each block including a set of parallel electrodes arranged so that the anodes are accommodated in the space defined between two cathode surfaces, so as to keep the interpolar distance constant, characterized in that the anodes and cathodes are mounted, respectively, on substantially vertical anode and cathode ends so as to provide a space above the anode and cathode units. The cathodes include perforated elements and at least one surface of the cathode elements faces towards an anode surface. The perforations provide a sufficient proportion of cavity to permit the exit of the gases contained in the interpolar space. The other surface of the cathode elements faces towards another cathode surface, so as to define, with said other cathode surface, a cathode space in which the products of the anodic and cathodic reactions can react. The cathodes also contain openings at the top, so as to make the cathode space communicate with the open space provided above the anode and cathode units, and so as to permit the exit of gaseous substances contained in the cathode space.

The perforated elements may be carried by one and the same cathode or by two separate cathodes.

A cathode according to the invention may, e.g., be formed by elements shaped like an elongated "M" or like a "U", with at least the elements facing towards the anode surfaces containing perforations. It may equally be formed by separate "L"-shaped elements arranged facing one another, or may be in the form of parallelipipedal boxes with one side open, two boxes having their open sides facing towards on another, and each box containing openings, at least at the top, to allow gases to escape upwardly.

It is further advantageous for the perforated elements facing towards the anode surface to contain a proportion of cavities at least equal to 10% and preferably at least equal to 30% of the surface.

Owing to its arrangement in accordance with the invention, the interpolar distance may be reduced to a minimum. The distance depends on operating conditions such as density per unit volume, temperature, etc. However, for normal operating conditions and particularly for temperatures of the order of 70° - 80° C., and with anodes of a material which is geometrically stable under conditions of electrolysis, e.g., material based on titanium or tantalum, the distance may be reduced to values in the range from about 2 to 4 millimeters.

Under the same conditions, the width of the previously defined cathode space may have values of from about 4 to 12 centimeters.

However, one could obviously use anodes made of any other material, such as graphite, without going beyond the scope of the invention.

Particularly in the case of metal anodes which permit very short interpolar distances, it is necessary for the unit comprising the anodes and the cathode elements to be rigid. Since the anodes may be large in area, rigidity is obtained, in a preferred embodiment of the invention, by the presence of spacers which are made of an insulating material and distributed between the anodes and the cathode elements facing them. The spacers may either be carried by the anode or by the cathode elements or may comprise two elements, one carried by the anode and the other by the cathode.

Finally, in order to diminish tip effects, the anodes may be provided at their ends with insulating elements such as rods (baguettes) or other members.

Generally speaking, the anode and cathode blocks according to the invention comprise the electrolytically active part of the cell. The two blocks are incorporated in a tank made of any appropriate, chemically inert material. The tank may, e.g., be made of steel, possibly treated to make it chemically inert relative to the electrolyte, or it may be made of a plastics material.

The anode and cathode ends may either be made integrally with a said wall of the tank or may each be added to a wall of the tank.

In addition to the tank, the cell generally comprises an upper, closed portion and an insulating base on which the tank rests. The upper portion of the cell advantageously includes an extension made of a material which is chemically inert but which need not respond to such high mechanical requirements as the tank. The tank, for example, is made of a plastics material such as polyvinylchloride and may include means for supplying and discharging electrolyte.

To make the circulation of electrolyte more uniform, the electrolyte may be introduced in the electrolytically-active part of the cell, either directly or indirectly by means of descending tubes which extend from an electrolyte supply pipe located in the upward extension. The extension may itself have a separate cover over it, provided with a means for evacuating gases.

As already explained, one of the essential advantages of the cell according to the invention is that it has an electrolytic arrangement, in a simple, compact form, capable of operating at the lowest possible voltages.

It seems quite obvious that an effort must be made not to lose the advantages of the invention, particularly the possibility of arranging the anode and cathode ends substantially vertically, by using current supply and distribution means which would suffer serious leakages.

In a preferred embodiment of the invention, the anode end comprises a copper plate with the anodes fixed on it by any electrically and mechanically appropriate means. The anode end has projecting conductive portions which are connected to electrical connecting elements. In another, equally appropriate embodiment, the anode end is made of an insulating material, such as a plastics material, or of concrete, possibly treated to make it chemically inert under conditions of electrolysis. In this case, the anodes are rigidly connected to distributing bars made of a conductive material. The bars are themselves rigidly connected to equipotential bars, the latter being in turn connected to the connecting elements.

In all these cases, the current advantageously flows through a plane perpendicular to the anode and cathode ends and parallel with the plane of the anodes and cathodes.

SPECIFIC DESCRIPTION OF THE INVENTION

The invention will be understood more easily from the appended drawings and examples of construction and operation which follow. These are given to illustrate the invention and are intended neither to delineate the scope of the invention nor limit the scope of the appended claims. Unless otherwise stated, the quantities of materials are expressed in terms of parts by weight.

Figure 1:
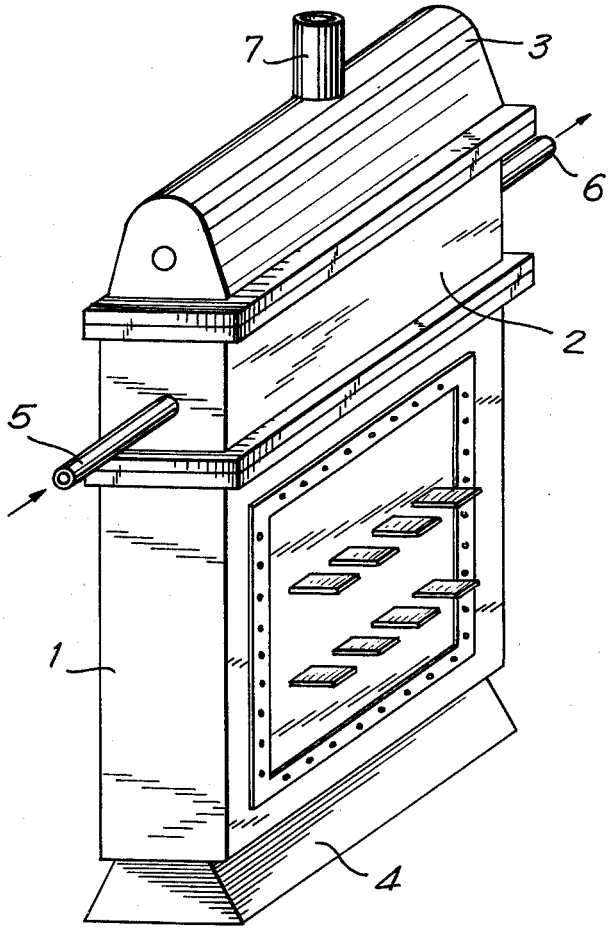
FIG. 1 is an overall perspective view of a cell according to the invention.

Turning first to the drawings, as can be seen from FIG. 1, a cell according to the invention comprises an electrolytically-active portion 1 with an upward extension 2 and ends with a cover 3. The whole unit rests on a stand 4.

The liquor or electrolyte enters the extension 2 by means of a pipe 5 and leaves through another pipe 6.

Gases are eliminated at pipe 7, through the top of cover 3.

Figure 2:
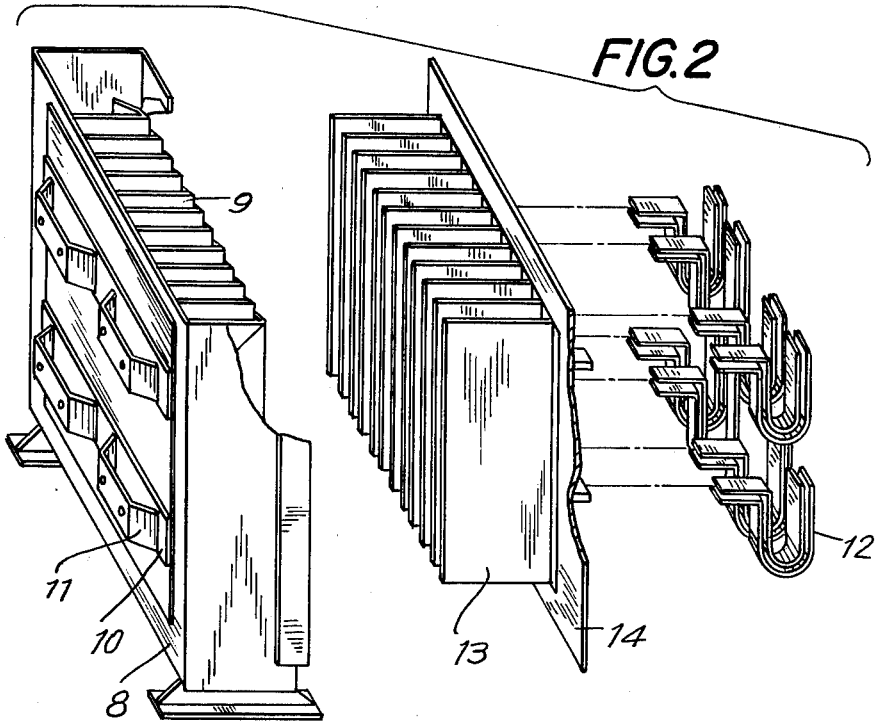
FIG. 2 is an exploded view of the electrochemically active part of the same cell.

As shown in FIG. 2, the electrolytically-active portion comprises a steel frame 8 carrying a cathode unit, rigidly connected to said frame 8 and comprising cathodes 9. The electrical connection is provided by a plate 10 made of a conductive material, such as copper, and carrying contact elements 11. Contact elements 11 are connected, e.g., by screwing, to U-shaped connecting elements 12 which are preferably in the form of copper foils.

Figure 3:
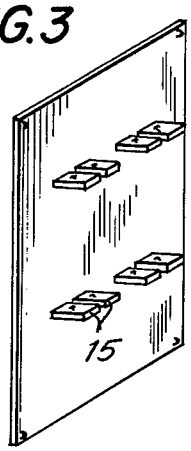
FIG. 3 shows the conductive, anode end of the same cell.

As illustrated in FIG. 2, the anode unit may comprise blade-shaped anodes 13 mounted perpendicularly to a conductive end 14 made of copper. The end can be seen best from FIG. 3; it has electrical connecting elements 15. Elements 15 are arranged perpendicularly to plate 14 and connected to connecting elements 12 Anodes 13 are mounted on end plate 14 as indicated in FIG. 4. Plate 14 is covered by a protective member 16 made of titanium. Holes 17 are formed in plate 14 to give passage to a titanium bolt 18. L-shaped anode 13 lies flat against element 16 and is held in position by bolt 18, a titanium washer 19, a lock-nut 20 and a nut 21.

In a different embodiment, illustrated in FIG. 5, bolt 18 is screwed directly into copper plate 14.

In another embodiment shown in FIG. 6, the anode end 23 of the cell is made of a non-conductive material, in this case concrete, and the anode unit comprises flat anodes 22 which are embedded in the concrete end. Current is distributed by a set of horizontal and vertical copper bars 24 and 25, respectively, the set being connected in the same way as in the FIG. 2 embodiment.

The arrangement of anodes and cathode elements can be seen more clearly from FIGS. 7 to 10.

Figure 7:
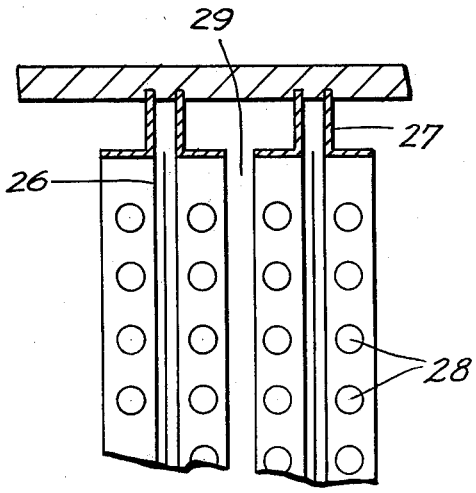
Figure 8:
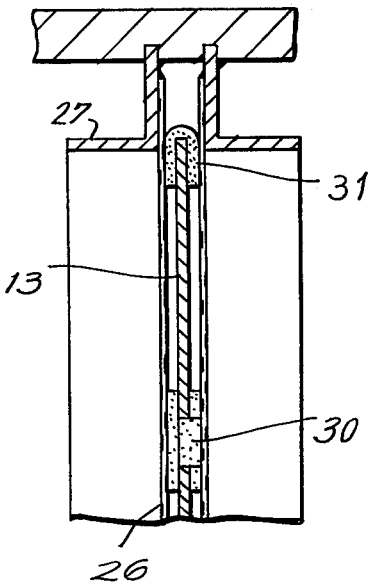

FIGS. 7 and 8 are plan views of an embodiment of a cathode structure comprising a cathode element 26 which contains perforations and is mounted on a T-tube 27. Each cathode element 26 contains openings 28 at the top, to allow gases to be evacuated. The cathode space comprises two cathode elements 26 facing one another. These may be separated by an empty space 29.

FIG. 8 further illustrates a spacer 30 mounted on anode 13. This enables the interpolar distance and the rigidity of the unit comprising the anode element and the cathode element to be kept constant.

FIG. 8 further shows an element 31 arranged at the end of anode 13. This acts both as a spacer and an insulator, enabling the tip effect to be reduced.

Figure 9:
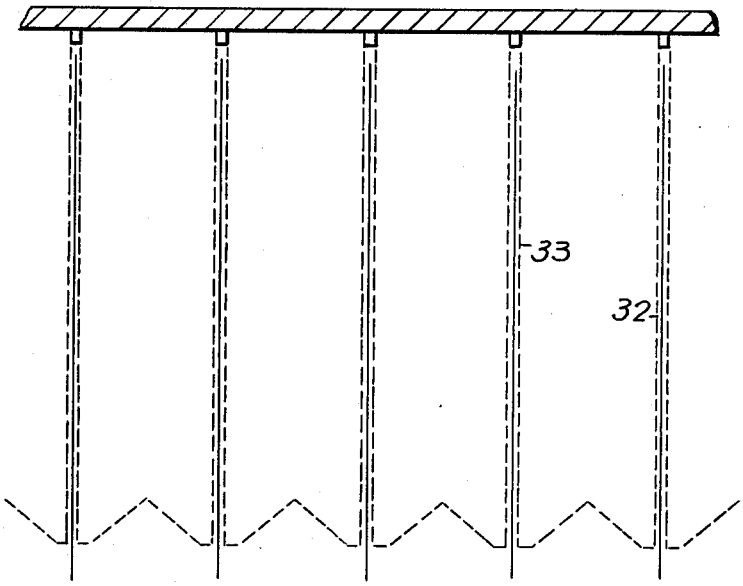
Figure 10:
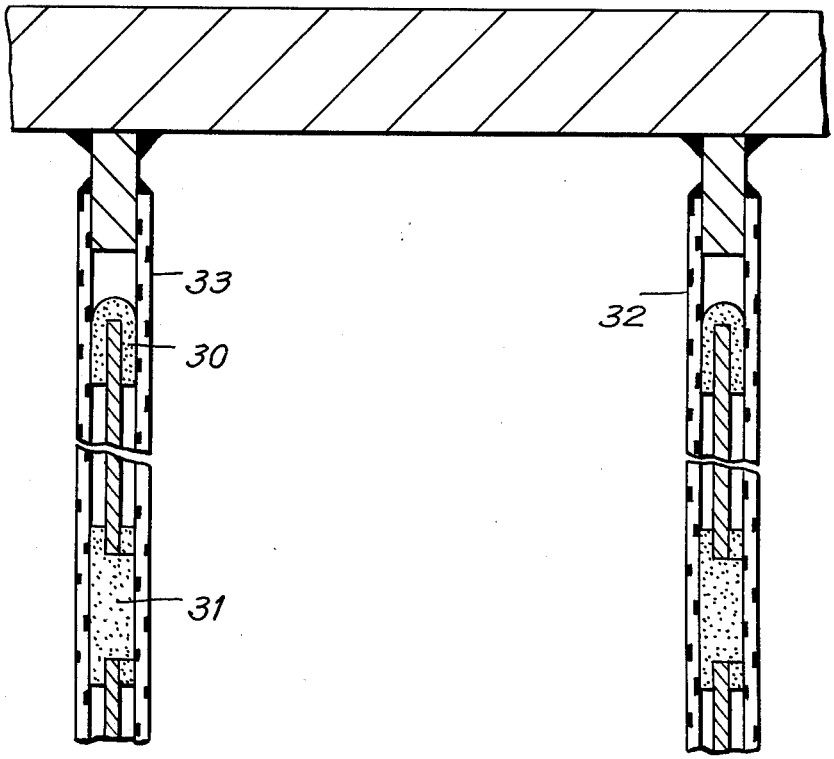

FIGS. 9 and 10 represent another embodiment, again in plan. In this embodiment, the cathode space is defined by two cathode elements 32 and 33 carried by one and the same "M"-shaped cathode. As in the previous case, the interpolar space is kept constant by spacers 30 and 31.

The importance of the invention can be demonstrated further by the following example. This employs a call with a non-conductive end as illustrated in FIG. 6, comprising metal anodes with an active surface area of 8.75 sq. meters. The cell is filled with 710 liters of a sodium chloride liquor or electrolyte of the following composition:

| | |
|---|---|
| NaCl | 290 g./liter |
| CA++ | <5 ppm |
| Mg++ | |
| $Na_2Cr_2O_7$ | 5 g./liter |

A high enough voltage is then applied to make a current of about 25,000 amps flow, corresponding to a current density in the vicinity of 28.6 amperes per square decimeter and a density per unit volume of 35 amperes per liter. The cell is then fed with the same liquor at the rate of about 40 liters per hour. A recirculating pump (not shown) enables the electrolyte to be recirculated between the cell and a heat exchanger at a rate of 2,000 liters per hour. This arrangement allows the electrolyte to be kept at 75° C. at the level of the cell. Dilute hydrochloric acid is fed into the external electrolyte circuit at a rate of 0.7 liters per hour, so as to keep the pH level in the electrolytic cell close to 6.5. The experiment is continued in this way for 15 days.

Under these conditions an average voltage of 3.2 V is obtained at the terminals of the cell. The effluent solution collected is analyzed and found to be of the following average composition:

| | |
|---|---|
| NaCl | 120 g./liter |
| $NaClO_3$ | 600 g./liter |

The gases escaping from the cell, consisting chiefly of hydrogen, are collected and analyzed. The average oxygen content is found to be in the region of 3% and the chlorine content approximately 0.4%.

The average Faraday yield in the conversion of chloride to chlorate, estimated by analyzing the gases and measured by collecting the effluent solution over periods of 24 hours of operation, is found to be 94%.

The means according to the invention are obviously not limited to the constructions and applications just described. In particular, the form and nature of the means may vary according to the types of electrolysis applied. Thus, in the case where perchlorates are obtained the cathodes used must be made of bronze, and not of steel as in the case of chlorates. The anodes may be of any material other than titanium or graphite and, depending on the type of liquor, the tank may be of any material other than steel.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrolytic cell, without a diaghragm, wherein products resulting from the anode and cathode reactions react together inside the cell, suitable for use in obtaining alkali chlorates from alkali chlorides, said electrolytic cell comprising an anode block and a cathode block, each block including a set of parallel electrodes arranged so that the anodes of said anode block are accommodated in the space defined between two cathode surfaces of the cathodes of said cathode block, the interpolar space being kept constant, wherein said anodes and cathodes are mounted on substantially vertical anode and cathode ends so as to provide an open space above the anode and cathode units; the cathodes including perforated elements; at least one surface of the cathode elements facing an anode surface with said surface of said cathode elements being perforated and the proportion of cavities of said perforations being at least about 10% of said cathode surface; thereby permitting exit of the gases contained in the interpolar space; the other surface of said cathode elements facing another cathode surface, so as to define a cathode space in which the products of the anode and cathode reactions can react; and the said cathodes also containing openings at least at the top, so as to permit the cathode space to communicate with the open space provided above said anodes and cathode units, and so as to permit exit of the gaseous substances contained in the cathode space; said interpolar distance being from about 2 to 4 millimeters, and the width of said cathode space being from about 4 to 12 centimeters.

2. An electrolytic cell according to claim 1, characterized in that said perforated cathode elements facing the anode surfaces are carried by one and the same cathode.

3. An electrolytic cell according to claim 1, characterized in that said perforated cathode elements facing the anode surfaces are carried by two separate cathodes.

4. An electrolytic cell according to claim 1, characterized in that said cathodes are "M"-shaped.

5. An electrolytic cell according to claim 1, characterized in that said cathodes are "U"-shaped.

6. An electrolytic cell according to claim 1, characterized in that said cathodes are "L"-shaped.

7. An electrolytic cell according to claim 1, characterized in that said cathodes are elements shaped as parallelipipedal boxes with one open side, two boxes having their open sides facing towards one another, and each box containing openings, at least at the top, through which gaseous substances can escape in an upward direction.

8. An electrolytic cell according to claim 1, characterized in that the perforated cathode elements facing the anode surfaces contain a proportion of cavities equal to at least 30%.

9. An electrolytic cell according to claim 1, characterized in that it has spacers made of an insulating material between the anodes and the cathode elements.

10. An electrolytic cell according to claim 1, characterized in that the anode unit comprises a set of anodes mounted on a conductive end.

11. An electrolytic cell according to claim 1, characterized in that the anode unit comprises a set of anodes mounted on a non-conductive end.

12. An electrolytic cell according to claim 1, characterized in that it further comprises means for distributing and supplying current, arranged so that the current flows in a plane perpendicular to the anode and cathode ends and parallel with the plane of the anodes and cathodes.

13. An electrolytic cell according to claim 1, characterized in that the anode and cathode blocks are arranged in a tank, of which they form two walls facing towards one another.

14. An electrolytic cell according to claim 13, characterized in that at least the end with one of the anode or cathode blocks is added to at least one side wall of the tank.

15. An electrolytic cell according to claim 1, characterized in that it further comprises a base, on which rests a tank containing the anode and cathode blocks, an upward extension and a cover.

16. An electrolytic cell according to claim 15, characterized in that said upward extension comprises means for supplying and discharging liquor.

17. An electrolytic cell according to claim 15, characterized in that the said cover comprises means for evacuating gaseous substances.

18. An electrolytic cell according to claim 1, characterized in that the supply of electrolyte takes place above the electrolytically-active part of the cell containing the anode and cathode blocks.

19. An electrolytic cell according to claim 1, characterized in that the supply of electrolyte takes place in the electrolytically-active part of the cell containing the anode and cathode blocks.

* * * * *

UNITED STATES PATENT AND TRADEMARK OFFICE

CERTIFICATE OF CORRECTION

PATENT NO. : 4,060,475

DATED : November 29, 1977

INVENTOR(S) : Daniel Fournier et al.

It is certified that error appears in the above-identified patent and that said Letters Patent are hereby corrected as shown below:

Column 1, line 49, delete "passge" and replace with -- passage --.

Column 2, line 46, delete "ortions" and replace with -- portions --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*